US007063519B2

(12) United States Patent
Agrawal et al.

(10) Patent No.: US 7,063,519 B2
(45) Date of Patent: Jun. 20, 2006

(54) MOTOR DRIVEN CENTRIFUGAL COMPRESSOR/BLOWER

(75) Inventors: Giridhari L. Agrawal, Simsbury, CT (US); Charles W. Buckley, West Hartford, CT (US)

(73) Assignee: R & D Dynamics Corporation, Bloomfield, CT (US)

( * ) Notice: Subject to any disclaimer, the term of this patent is extended or adjusted under 35 U.S.C. 154(b) by 374 days.

(21) Appl. No.: 10/612,656

(22) Filed: Jul. 2, 2003

(65) Prior Publication Data

US 2004/0005228 A1 Jan. 8, 2004

Related U.S. Application Data

(60) Provisional application No. 60/393,259, filed on Jul. 2, 2002.

(51) Int. Cl.
*F04B 17/03* (2006.01)

(52) U.S. Cl. ..... 417/423.1; 417/365; 417/370; 417/423.8; 417/423.12

(58) Field of Classification Search ..... 417/423.1, 417/423.12, 410.1; 416/204 R, 244 R
See application file for complete search history.

(56) References Cited

U.S. PATENT DOCUMENTS 3,391,291 A * 7/1968 O'Neil et al. ..... 310/90
3,981,628 A * 9/1976 Carter ..... 417/423.12
5,857,348 A 1/1999 Conry
6,102,672 A 8/2000 Woollenweber et al.
6,375,438 B1 4/2002 Seo
6,450,781 B1 9/2002 Petrovich et al.
6,498,410 B1 12/2002 Yashiro et al.
6,579,078 B1 6/2003 Hill et al.
6,634,853 B1 10/2003 Anderson
2004/0179947 A1* 9/2004 Agrawal et al. ..... 417/212
2004/0189126 A1* 9/2004 Brunet et al. ..... 310/90.5

OTHER PUBLICATIONS

Agrawal, Giri L., "Foil Air/Gas Bearing Technology—An Overview", Int'l. Gas Turbine & Aeroengine Congress & Exhibition, Jun. 1997, pp. 1-11, ASME, New York, NY, US.

* cited by examiner

*Primary Examiner*—Michael Koczo, Jr.
(74) *Attorney, Agent, or Firm*—McCormick, Paulding & Huber LLP

(57) ABSTRACT

This invention provides a small, high efficiency, oil free motor driven compressor/blower suitable for providing pressurized, contamination-free gas and or air to transportation, industrial and aerospace fuel cell systems or other contaminant-intolerant applications. The motor driven compressor/blower rotor assembly is supported by foil air bearings and rotates at high speed by using a high frequency drive. The impeller is a centrifugal type design. The MDC can be easily integrated into the air management system of a fuel cell.

2 Claims, 5 Drawing Sheets

MOTOR DRIVEN CENTRIFUGAL COMPRESSOR/BLOWER

CROSS REFERENCE TO RELATED APPLICATION

This application claims the benefit of U.S. Provisional Application No. 60/393,259, filed Jul. 2, 2002, which is incorporated herein by reference.

BACKGROUND OF THE INVENTION

1. Field of Invention

Various systems such as fuel cells and air separation plants to generate oxygen or nitrogen require highly efficient, compact and oil free motor driven compressors to compress working gas or air to a higher pressure level. The field of invention pertains to conception, design and manufacturing of small motor driven compressors, usually less than 10 kW, and associated technologies including their integration required for fuel cell systems for transportation, small power plants, and small air separation plants including one installed on an aircraft.

Historically, compressed gas/air has been generated by various types of motor driven machines, e.g. piston, screw, vane, and centrifugal etc. To achieve high efficiency the motor must drive centrifugal compressor/rotor at high rotative speeds. As rotative speeds become greater the overall machine size can be made smaller, while maintaining the same compressed gas/air flows and pressures. Requirements for running at high speeds include properly designed rotating and non-rotating assemblies and bearings to support the high speed rotating shaft, typically 30,000 rpm to 200,000 rpm.

2. Related Art

High speed turbine driven rotating machines supported on foil air bearings have made significant progress during the last 30 years. Reliability of many high speed rotating machines with foil bearings has shown a tenfold increase compared to those with rolling element bearings. Most high speed rotating machines are Air Cycle Machines (ACM) used in Environmental Control Systems (ECS) of aircraft that manage cooling, heating and pressurization of the aircraft. Today, ACM for almost every new ECS system on military and civil aircraft and on many ground vehicles use foil air bearings. Old ECS systems with rolling element bearings are being converted to foil air bearings. The F-16 aircraft ACM used rolling element bearings from 1974 to 1982, but all aircraft built since 1982 use foil air bearings. The 747 aircraft ACM used rolling element bearings from 1970 to 1989. All aircraft built since 1989 have foil air bearings. ECS on the older model 737 aircraft have rolling element bearings, whereas ECS on new 737 use foil air bearings. An overview of foil bearing technology is provided in an ASME paper (97-GT-347) by Giri L. Agrawal.

The use of foil bearings in turbomachinery has several advantages:

Oil Free Operation—There is no contamination with oil. The working fluid in the bearing is the system process gas which could be air or any other gas. For many systems such as fuel cells oil free operation is a necessity.

Higher Reliability—Foil bearing machines are more reliable because there are fewer parts necessary to support the rotative assembly and there is no lubrication needed to feed the system. When the machine is in operation, the air/gas film between the bearing and the shaft protects the bearing foils from wear. The bearing surface is in contact With the shaft only when the machine starts and stops. During this time, a coating on the foils limits the wear.

No Scheduled Maintenance—Since there is no oil lubrication system in machines that use foil bearings, there is never a need to check and replace the lubricant. This results in lower operating costs.

Environmental and System Durability—Foil bearings can handle severe environmental conditions such as shock and vibration loading. Any liquid from the system can easily be handled.

High Speed Operation—Compressor and turbine rotors have better aerodynamic efficiency at higher speeds. Foil bearings allow these machines to operate at the higher speeds without any limitation as with ball bearings. In fact, due to the hydrodynamic action, they have a higher load capacity as the speed increases.

Low and High Temperature Capabilities—Many oil lubricants cannot operate at very high temperatures without breaking down. At low temperature, oil lubricants can become too viscous to operate effectively. Foil bearings, however, operate efficiently at severely high temperatures, as well as at cryogenic temperatures.

The air cycle machines described above are turbine driven. The motor driven rotating machines require various additional technologies for operation. They are:

The foil bearings must have higher spring rate to compensate for negative spring rate for the motor rotor.

More cooling flow is required between rotor shaft and the stator to cool the additional heat generated by motor.

An effective cooling scheme is required for the high speed motor stator.

Motor material cannot handle tensile stress generated by bending.

The centrifugal compressor should not surge under normal low flow condition which could be approximately 10% of the design flow resulting in 20% of the design speed.

Motor driven machines will be longer than turbine driven machines. Hence bending critical speed should not create problem.

Controller should provide high frequency required for the high operating speed.

SUMMARY OF THE INVENTION

The present invention resides in a high speed, high efficiency motor driven compressor for compressing various gaseous mediums such as refrigerants or air. The compressor is suitable for providing pressurized, contaminant-free gas and/or air to transportation, industrial aerospace or fuel cell systems, or for other contaminant-intolerant applications.

The motor driven compressor includes a compressor housing and a rotating assembly mounted for rotation about an axis within the housing. In one aspect of the invention, the motor rotor includes a permanent magnet which is encapsulated by a sleeve press-fit over the permanent magnet with end caps connected to the sleeve. The encapsulation of the permanent magnet protects the magnet against load stresses at high rotor speeds, for example speeds in the range of 30,000 rpm or more.

In another aspect of the invention, the rotating assembly within the motor driven compressor has an impeller forming a part of the compressor stage within the housing, the motor rotor, which again forms an armature of the motor for driving the rotating assembly about an axis within the housing, and two journal bearing shafts disposed along the axis at opposite sides of the motor rotor. A tie rod extends along the axis of rotation of the assembly and holds the impeller, the motor rotor and the two journal bearings together under a preload. A thrust load balancing disk may also be added to the rotating assembly and is likewise held under a preload by the tie rod.

In a further aspect of the invention, the rotating assembly includes the impeller, the motor rotor forming the armature of the motor, two journal bearing shafts, a thrust load balancing disk balancing the axial load developed by the impeller and a thrust bearing disk establishing an axial position of the rotating assembly along the axis within housing. First and second journal bearings in the housing cooperate with the journal bearing shafts to support the rotating assembly within the housing, and a thrust bearing mounted within the housing cooperates with the thrust bearing disk. As a consequence the journal bearings and the thrust bearing establish and maintain both the radial and axial position of the rotating assembly within the housing. In a preferred embodiment of the invention the journal bearings and the thrust bearings are oil-less foil gas bearings.

In still a further aspect of the invention, the motor driven compressor includes cooling ducts deriving bleed gas from the impeller and extending through the rotating assembly in the journal bearings for cooling the compressor during operation. The cooling ducts also extend from the rotating assembly and journal bearings back to the inlet of the compressor housing so that the portion of the gas medium utilized for cooling is not discharged to atmosphere.

In still a further embodiment of the invention, the compressor housing may include a two-piece volute receiving the gas medium discharged from the impeller. The volute constructed from two pieces defines a passageway having a rectangular cross section through which the compressed gaseous medium flows from the impeller.

In still a further aspect of the present invention, a centrifugal compressor having a compressor housing and rotating compressor assembly with an impeller includes a volute passageway leading from the discharge of the impeller for the compressed gaseous medium. In order to improve low-flow performance a plurality of airfoil-shaped diffusers are disposed in the passageway.

DETAILED DESCRIPTION OF THE INVENTION AND PREFERRED EMBODIMENTS THEREOF

Figure 1:
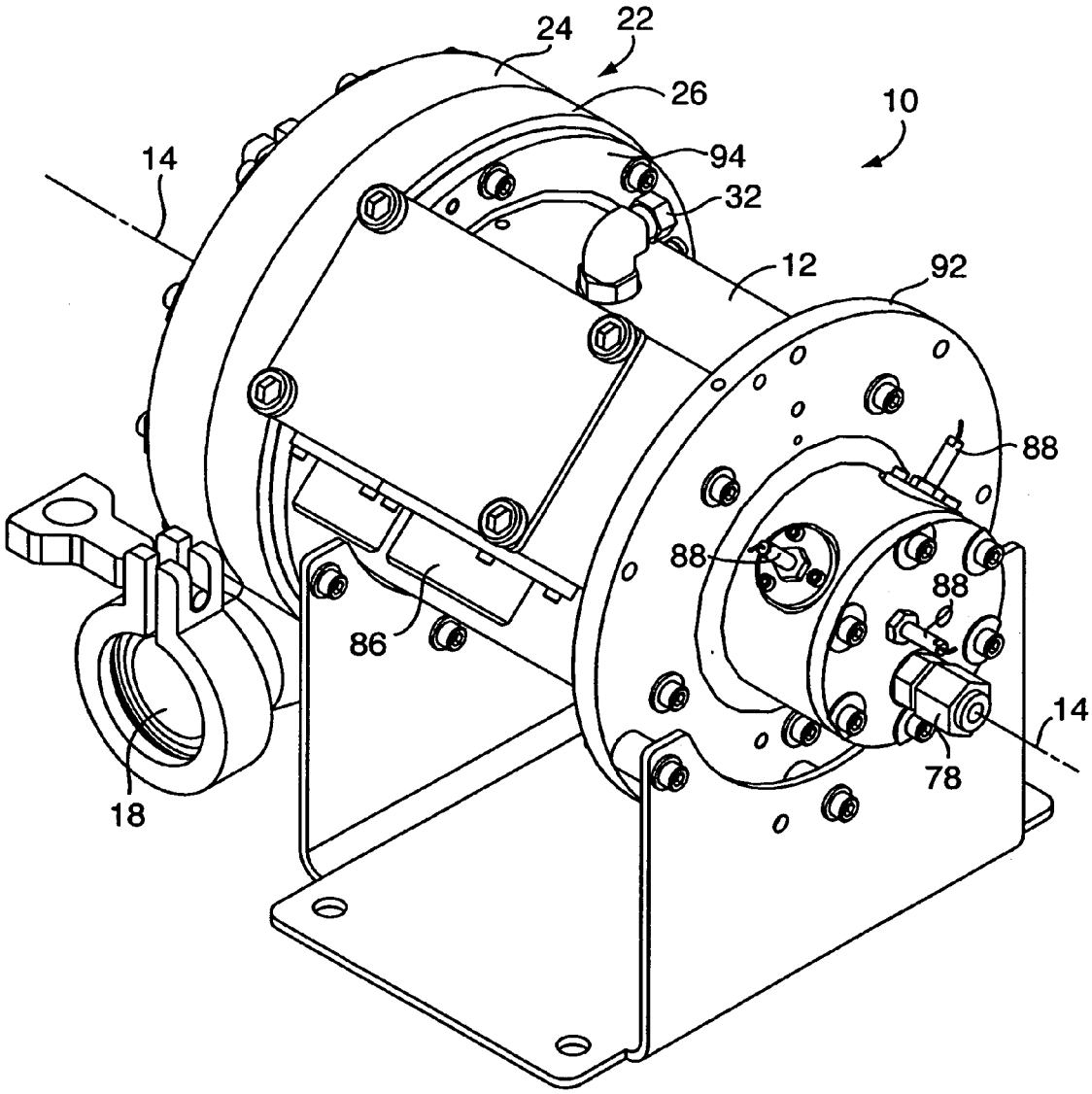
FIG. 1 is a perspective view of the compressor/blower.
Figure 2:
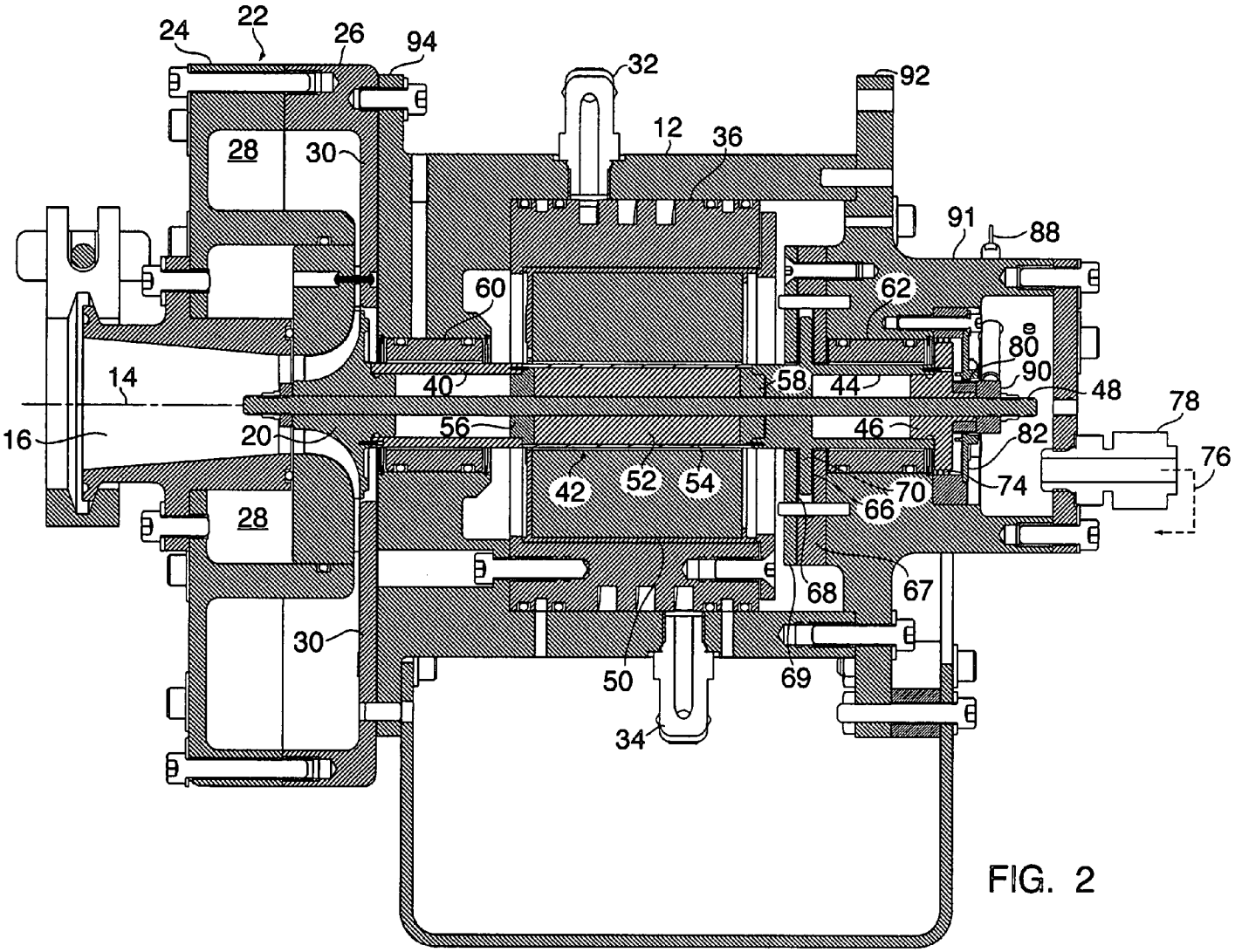
FIG. 2 is a sectional view of the compressor/blower as shown in FIG. 1.
Figure 3:
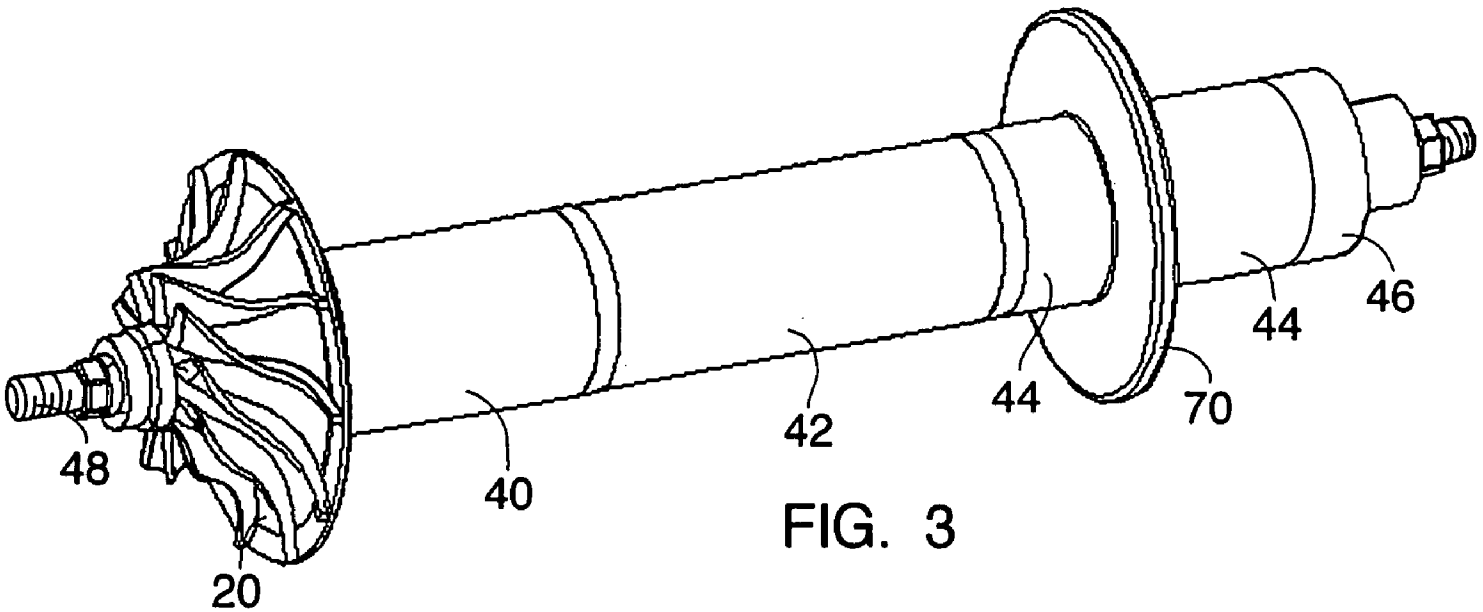
FIG. 3 is a picture of the rotating assembly in the compressor/blower of FIG. 1.
Figure 5:
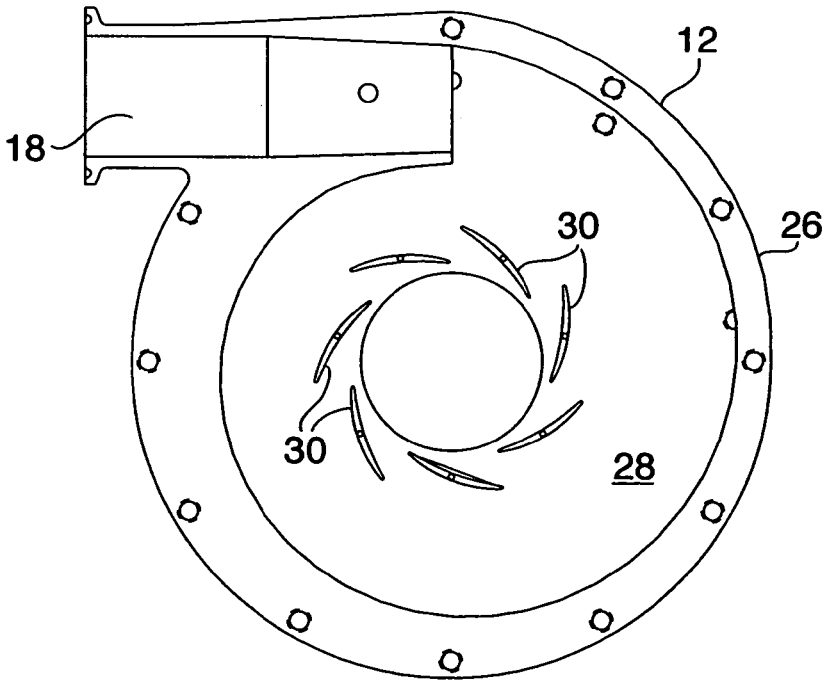
FIG. 5 is a side view of one part of the diffuser of the compressor/blower of FIG. 1.

An outside view and cross section of the motor driven compressor 10 is shown in FIGS. 1 and 2 respectively. The compressor has a housing 12 which is generally symmetric about a central axis 14. At one end of the housing as shown most clearly in FIGS. 1 and 2 is an inlet 16 for the fluid medium, generally air, to be compressed, and a discharge 18 for the compressed fluid. The inlet leads to a single centrifugal compressor stage comprised of an impeller 20 and a diffuser 22 surrounding the impeller and the inlet 16. The diffuser is formed in at least two parts or pieces 24, 26 which allows the volute receiving the compressed medium from the impeller to have a square or generally rectangular cross section as shown most clearly in FIG. 2. The part 26 of the diffuser also is shown in FIG. 5 and contains airfoil shaped diffusing blades 30 which permit the compressor to operate at as low as 2% of design flow without surging.

The housing (12) also includes a cooling inlet (32) and cooling outlet (34) as shown in FIGS. 1 and 2 for circulating a liquid cooling medium through a corkscrew shaped path defined by an inner cooling ring (36) and the inner surface of the housing (12). Alternatively, the ring could be provided with a finned exterior for forced gas/air cooling.

As shown in FIG. 2 the rotating assembly of the compressor includes the impeller (20), a first journal bearing shaft (40), a permanent magnet motor rotor (42), and second journal bearing shaft (44), a thrust load balancing disk (46) balancing the pressure load of the impeller and a tie-rod (48) interconnecting each of the rotating elements. The tie rod clamps the elements of the rotating assembly together to counteract any centrifugal loading on the elements while the compressor operates at high speeds. For example, it is contemplated that the rotating assembly will be driven by the encapsulated motor rotor about the axis (14) in the range of 30,000–200,000 rpm.

Figure 7:
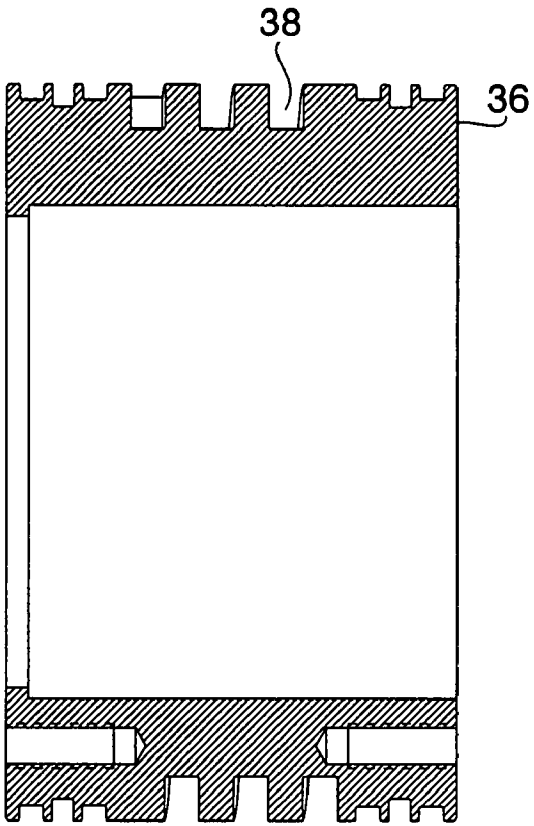
FIG. 7 is a cross sectional view of the inner cooling ring in FIG. 6.
Figure 6:
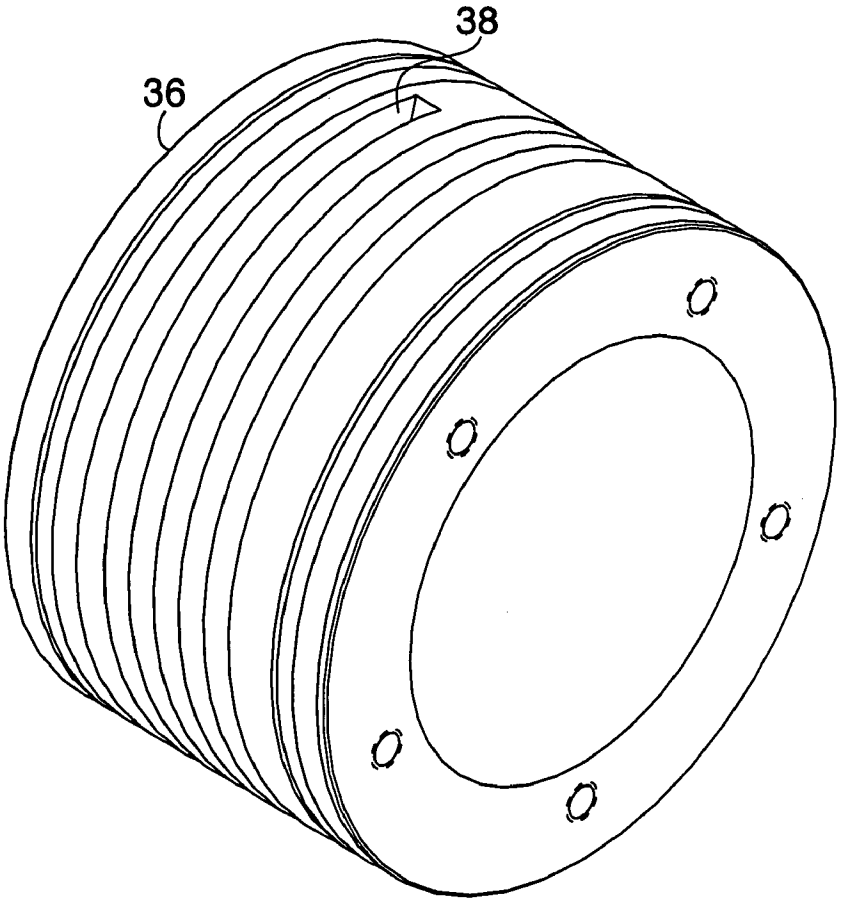
FIG. 6 is a perspective view of the inner cooling ring with cork-screw shaped cooling paths.

The inner cooling ring (36) is shown in a perspective view in FIG. 6 and in cross section in FIG. 7. The corkscrew groove (38) begins at one point on the circumference of the ring that is located adjacent to the inlet (32) of the housing and terminates near the outlet (34). O-rings to seal the ring within the housing are shown in FIG. 2.

The motor rotor (42) in the rotating assembly forms the armature of a electrically driven permanent magnet, high speed motor in which the stator (50) is fixedly retained within the inner cooling ring (36) as shown in FIG. 2. The motor rotor (42) includes a permanent magnet (52) which is encapsulated within a press-fit sleeve (54) with two end caps (56, 58). The press fit between the sleeve and the permanent magnet together with a pre-load provided to the rotating assembly by the tie rod (48) resists bending moments in the rotating assembly at high speeds. The material forming the sleeve and end caps is preferably a non-magnetic stainless steel or Inconel.

Figure 4:
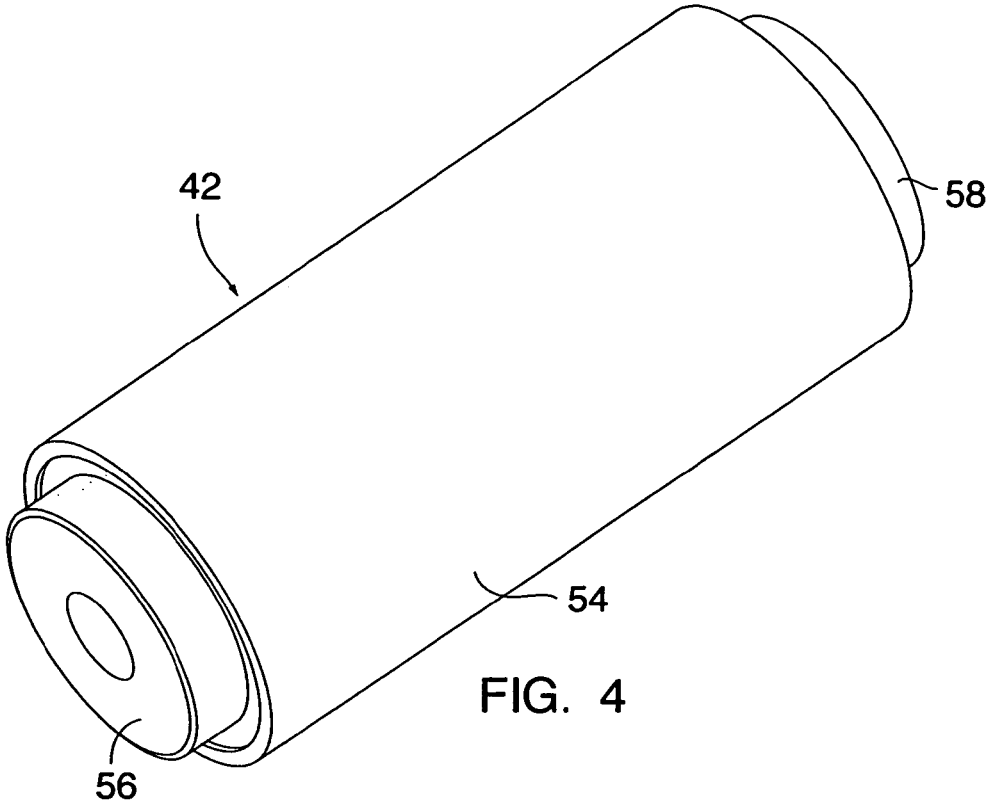
FIG. 4 is a picture of the encapsulated permanent magnet motor rotor forming a part of the rotating assembly of FIG. 3.

FIG. 4 shows the encapsulated motor rotor including the shoulders formed by the end caps (56, 58). The shoulders aide in aligning the motor rotor (42) with the journal bearing shafts (40, 44) at each end of the rotor. The journal shafts are in turn hollow at their outer ends and receive the impeller (20) at one end of the assembly and the thrust load balancing disk (46) at the other end. By pre-loading the tie rod (48), all of the rotating elements are held in alignment along the axis (14), and rigidity or resistance to bending of the rotating assembly at high speed is improved.

The rotating assembly consisting of the impeller, journal bearing shafts (40, 44), the thrust load balancing disk (46) and the rotor motor (42) are supported for high speed rotation within the housing by means of oil-less high spring rate, foil gas journal bearings (60, 62) at each side of the motor rotor (42) and two high-spring rate, high load capacity foil gas thrust bearings (66, 68) disposed at opposite sides of a thrust bearing disk (70) on the journal bearing shaft (44). The foil gas journal bearings have a high spring rate to maintain the radial positioning of the rotating assembly, and the foil gas thrust bearings have a high spring rate to maintain the axial position of the rotating assembly. The foil gas bearings have numerous performance, maintenance and contamination-free advantages over conventional roller or ball bearings as discussed in the Background of the Invention above.

A small amount of bleed air (or gas) leaks past the impeller (20) and flows through first journal bearing (60), the spacing between the motor rotor (42) and stator (50), the two foil gas thrust bearings (66, 68), the second journal bearing (62) and a labyrinth gas pressure seal (74) formed at the outer circumference of the pressure balancing disk (46). The bleed air cools the interior parts of the motor rotor and then goes back to the inlet (16) of the compressor by means of a return tube illustrated schematically at (76) and joined with a connector (78) at the one end of the housing. The return tube minimizes any overboard loss of the working medium being compressed and also helps in balancing the thrust load on the rotating assembly. Additionally the bleed air applied to the thrust load balancing disk (46) helps to balance the thrust load of the impeller. The disk (46) also helps distribute the load on the two journal bearings (60, 62) by being located on the opposite side of the motor rotor (42) with respect to the impeller (20).

A magnet (80) mounted on the thrust load balancing disk (46) for rotation with the disk cooperates with Hall effect sensors (82) to provide signals for commutation in the motor controls. The separate Hall effect magnet positioned outboard of the permanent magnet motor rotor allows for a non-stepped tie rod or shaft for the rotating assembly.

The motor controls, which are shown generally at (86) in FIG. 1 must operate at high frequency, and preferably at 12 volts up to 400 volts d.c. Radial probes (88) are distributed about the spacer (90) on the end of the rotating assembly to sense rotational speed or orientation.

The bearing housing portion (91) supports the journal bearing (62) and the housing (12) supports the journal bearing (60). The bearing housing portion (91) includes a flange (92) for supporting the compressor at one axial end, and the housing (12) includes a corresponding flange (94) adjacent the diffuser part (26) for supporting the compressor at the opposite end.

What is claimed is:

1. A motor driven compressor for compressing a gaseous medium comprising:

a compressor housing;

a rotating assembly mounted for rotation about an axis within the housing, and having;

a) an impeller forming part of a compressor stage within the housing;

b) a motor rotor forming an armature of a motor for driving the rotating assembly about the axis;

c) two journal bearing shafts disposed along the axis at opposite sides of the motor rotor; and d) a tie rod extending along the axis of rotation and holding the impeller, the motor rotor and the two journal bearing shafts under preload.

2. A motor driven compressor for compressing a gaseous medium as defined in claim 1 further including a thrust load balancing disk counterbalancing the axial thrust of the impeller along with axis within the housing, and the thrust load balancing disk also being held under a preload by the tie rod.

* * * * *